United States Patent [19]

Green et al.

[11] Patent Number: 4,925,196

[45] Date of Patent: May 15, 1990

[54] VEHICLE SPEED CONTROL SYSTEM

[75] Inventors: Charles J. Green, Redondo Beach, Calif.; John M. Morris, Auburn; Timothy L. Oliphant, Federal Way, both of Wash.

[73] Assignee: GT Development Corporation, Tukwila, Wash.

[21] Appl. No.: 278,741

[22] Filed: Nov. 30, 1988

[51] Int. Cl.[5] ..... F02B 77/00

[52] U.S. Cl. ..... 180/170; 123/333; 123/198 DB; 137/509; 137/613

[58] Field of Search ..... 180/170; 123/333, 198 DB; 137/509, 613

[56] References Cited

U.S. PATENT DOCUMENTS

| | | | |
|---|---|---|---|
| 2,164,114 | 6/1939 | Kolb | 180/170 |
| 2,989,971 | 6/1961 | Valentine | 137/509 |
| 3,302,980 | 2/1967 | Bystricky et al. | 137/509 |
| 3,738,346 | 6/1973 | Goodman | 123/198 DB |
| 4,011,848 | 3/1977 | Coddington | 123/198 DB |
| 4,245,598 | 1/1981 | Ruhl | 123/333 |
| 4,329,954 | 5/1982 | Dobbs | 123/198 DB |
| 4,424,830 | 1/1984 | Arnsperger et al. | 137/613 |

*Primary Examiner*—David M. Mitchell

*Attorney, Agent, or Firm*—Delbert J. Barnard

[57] ABSTRACT

A line pressure responsive flow control valve (46) is in series with a solenoid (34) operated off-on valve (26). These two valves (46, 26) are in a common housing having an inlet port (94) and an outlet port (96). A branch (24) of a bypass line (24, 24') extends from a fuel delivery line (10) to a fuel tank (16). A spring (76) biases a closure wall (70) of a piston (66) into contact with a valve seat (88) surrounding a valve orifice (90). Fuel pressure at the inlet (24) acts on the closure wall (70). When this pressure exceeds a predetermined minimum, the piston (66) is moved so as to open the valve orifice (90), allowing fuel to flow from the bypass line (24) to the off-on valve (26). The line pressure responsive flow control valve (46) functions to control flow through the bypass line (24, 24') at times when the off-on valve (26) is open.

15 Claims, 3 Drawing Sheets

Fig. 1
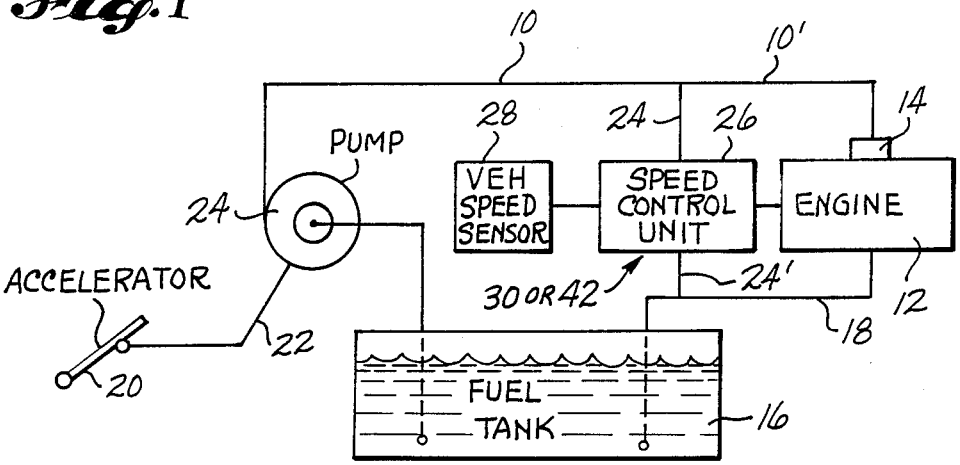
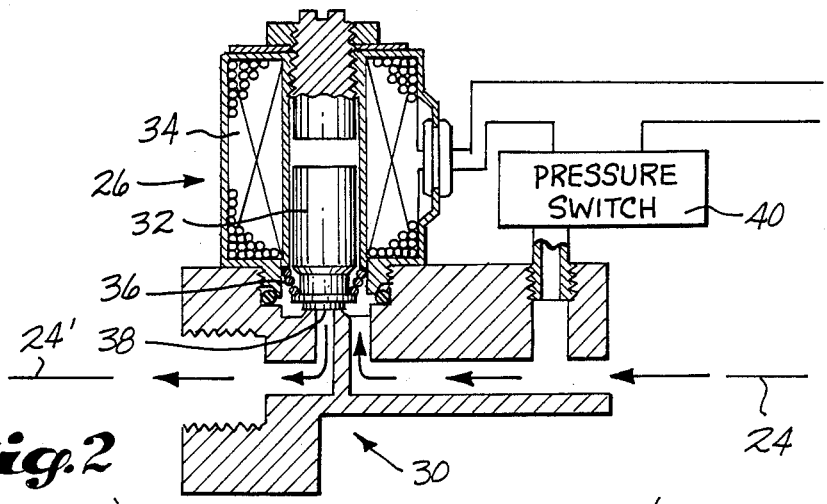
Fig. 2
(PRIOR ART)
Fig. 8
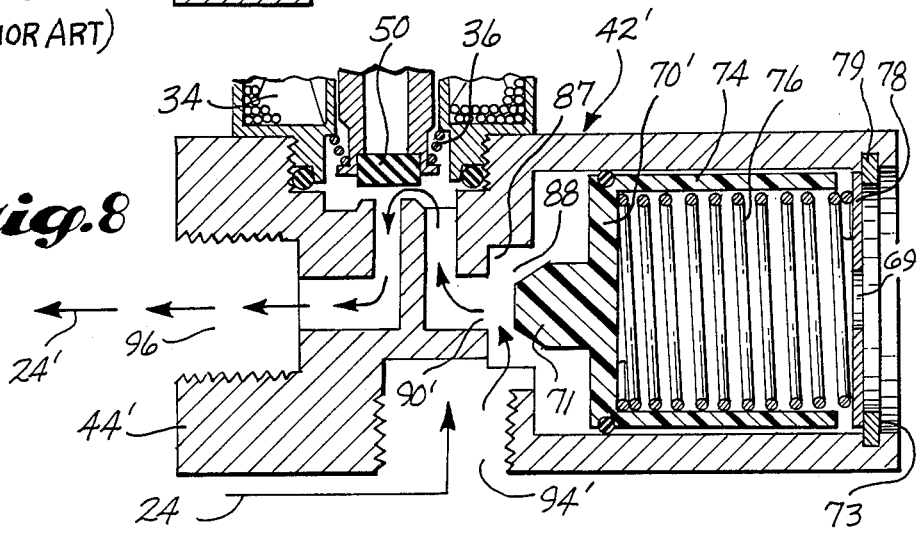

Fig. 5
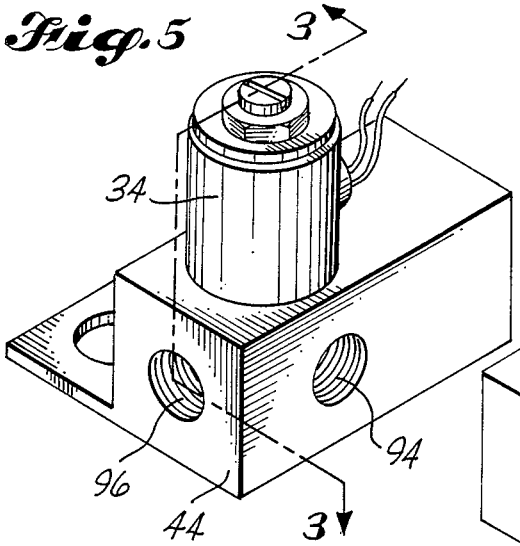
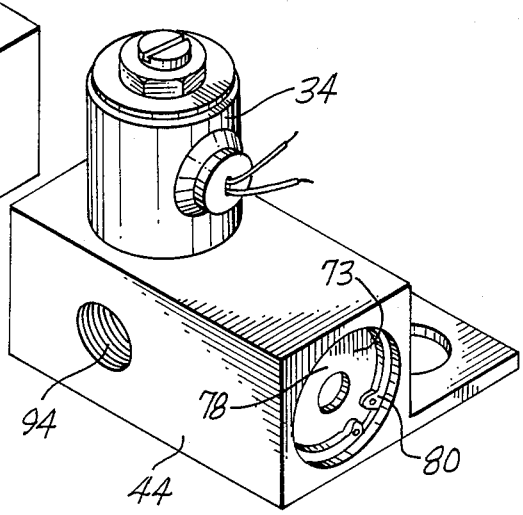
Fig. 6
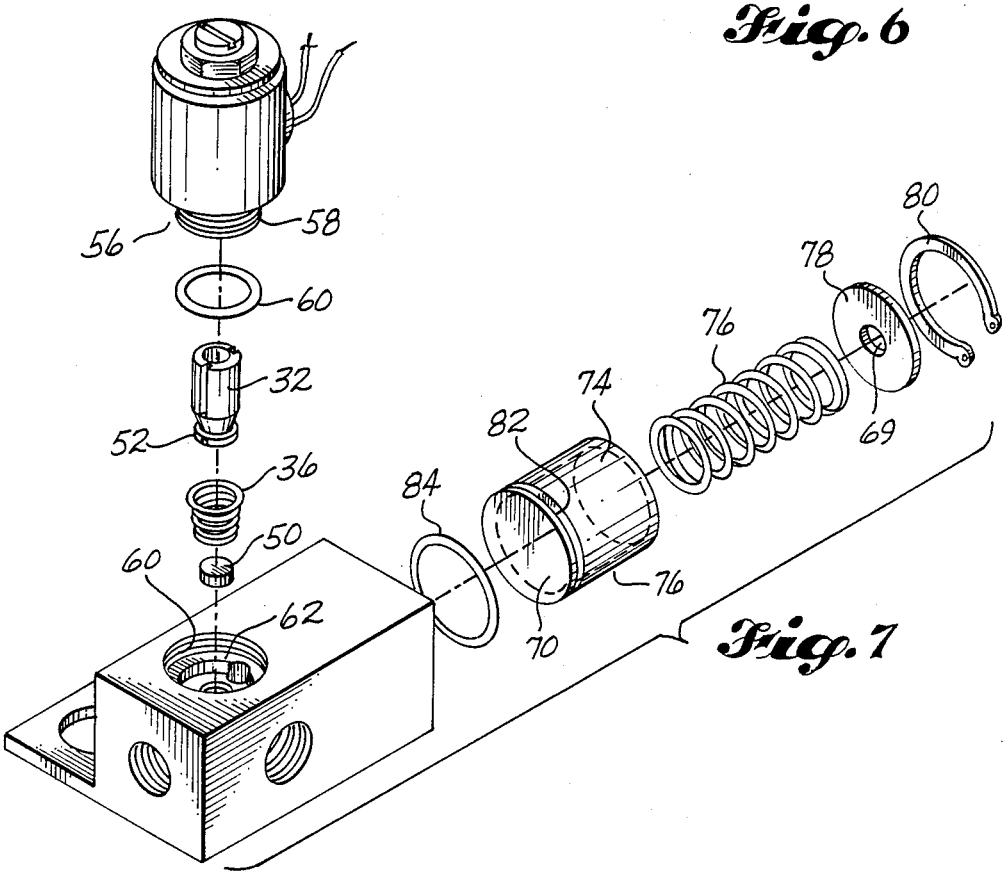
Fig. 7

VEHICLE SPEED CONTROL SYSTEM

TECHNICAL FIELD

This invention relates to a vehicle speed control system of a type which functions to reduce speed by diverting a portion of the fuel in a delivery line leading to the vehicle engine, back to the fuel tank, in response to a sensed overspeed condition of the vehicle. More particularly, this invention relates to improvements in this type of system.

BACKGROUND ART

Hewitt Industries of El Seguendo, California manufactures a vehicle speed control unit comprising a normally closed solenoid controlled on-off valve in a bypass line. When the vehicle speed exceeds a predetermined maximum speed the solenoid is energized to open the valve and divert some of the fuel through the bypass line back to the fuel tank, but only if the fuel delivery pressure is above a predetermined minimum pressure. The control circuit for the solenoid includes a first switch controlled by a vehicle speed sensor and a second switch controlled by pressure in the bypass line. The vehicle speed sensor senses a vehicle overspeed condition and in response closes the first switch. If the second switch is closed at the time, the solenoid is energized, causing it to open the on-off valve in the bypass line. This allows some of the fuel in the delivery line to flow back to the fuel tank, with the remainder of the fuel being delivered to the engine. Under some conditions of vehicle operation this bypass of fuel reduces the amount of fuel that is delivered to the engine below what is necessary to provide sufficient fuel at the engine for cooling the fuel injectors. The pressure responsive switch senses this condition. When there would be an insufficient delivery of fuel to the engine, during an overspeed condition of the vehicle, the pressure responsive switch opens the circuit, removing energy from the solenoid and allowing the off-on valve to close. This results in an immediate buildup in pressure and a functioning of the pressure switch to again activate the solenoid so as to again open the off-on valve. The problem with this type of system is that the constant turning of the off-on valve accelerates wear and greatly reduces the life of the valve.

A principal object of the present invention is to provide a bypass type speed control system which includes a solenoid controlled off-on valve in a bypass line but which is turned on by an overspeed condition of the vehicle and remains on until the vehicle speed is adequately reduced, while maintaining adequate fuel delivery to the fuel injection.

DISCLOSURE OF THE INVENTION

The speed control system of the present invention is basically characterized by a bypass line which extends from a fuel delivery line to a fuel tank. A normally closed off-on valve is located in the bypass line. A speed sensor senses vehicle speed and controls a solenoid valve to open the off-on valve in response to the vehicle speed exceeding a predetermined speed. A line pressure responsive flow control valve is positioned in the bypass line in series with the off-on valve. The line pressure responsive flow control valve includes a closure member which presents a pressure surface in the upstream direction. A spring normally biases the closure member into a closed position. Fuel in the bypass line upstream of the closure member exerts pressure on the pressure surface of the closure member. Whenever the pressure exceeds a predetermined pressure it moves the closure member into a valve opening position, allowing flow through the valve. The off-on valve remains open so long as the vehicle is traveling at an overspeed condition. The line pressure responsive flow control valve determines whether or not there shall be fuel flow through the bypass line, and the extent of such flow, in response to fuel pressure in the bypass line.

In a preferred embodiment, the off-on valve and the line pressure responsive flow control valve share a common housing. This housing includes an inlet port connected to a lead-in portion of the bypass line, which delivers fuel to the line pressure responsive flow control valve. It also includes an outlet port which is connected to a lead-out portion of the bypass line. Other more detailed features of the invention are described in the description of the preferred embodiment and are particularly pointed out in the appended claims.

BRIEF DESCRIPTION OF THE DRAWINGS

Like reference numerals refer to like part throughout the several views of the drawing, and:

FIG. 1 is a schematic view of an engine system in which the present invention is used;

FIG. 2 is a sectional view of a prior art speed control component which is replaced in the system by a component that is constructed in accordance with the present invention;

FIG. 5 is a pictorial view of the component shown by FIG. 3 and 4, taken from above and looking towards one end and one side;

FIG. 6 is a view like FIG. 5, also taken from above and looking towards the same side that is shown in FIG. 5 but towards the opposite end of the component; and FIG. 7 is an exploded pictorial view of the component shown by FIGS. 3–7; and FIG. 8 is a view like FIG. 4 of a modified embodiment of the invention.

BEST MODE FOR CARRYING OUT THE INVENTION

Figure 3:
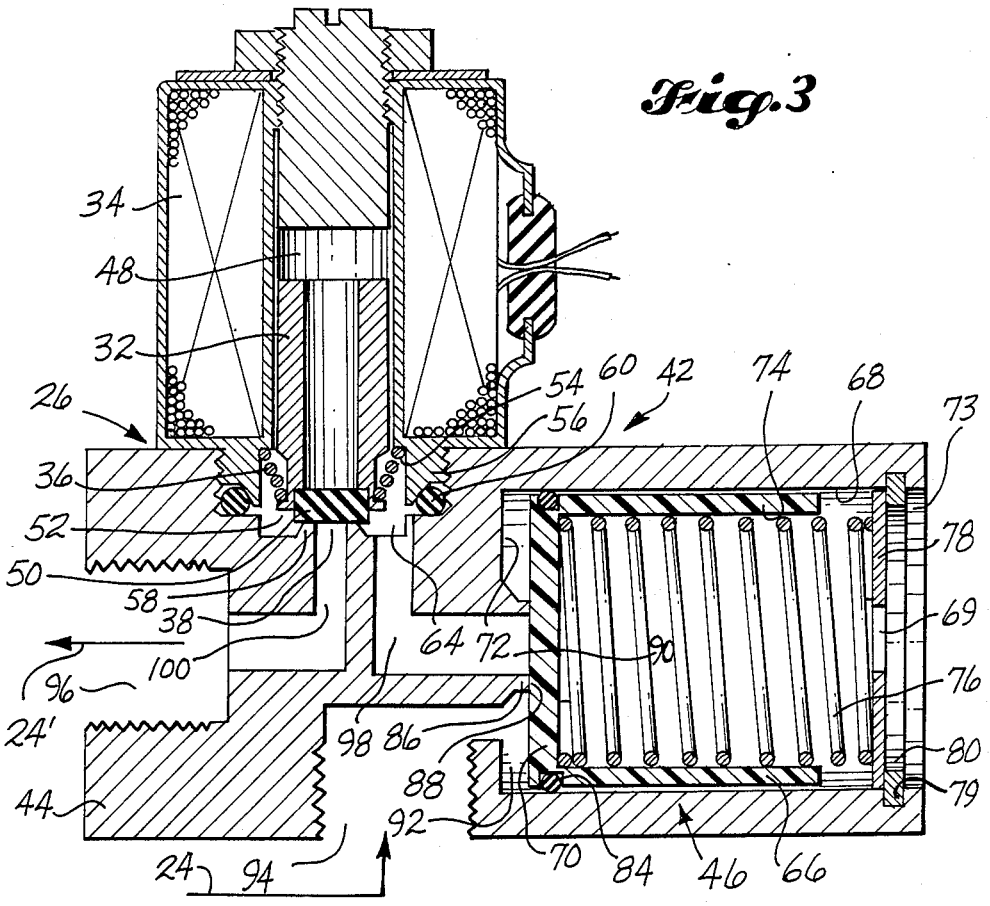
FIG. 3 is an enlarged scale view like FIG. 2 but of an embodiment of the present invention, such view showing a line pressure responsive flow control valve in a closed position.

Referring to FIG. 1, in a typical vehicular installation a fuel delivery line 10 delivers fuel under pressure to the vehicle engine 12. The fuel is delivered to the engine fuel injectors, one of which is schematically illustrated and designated 14. Some of the fuel is used for cooling the fuel injectors and is then returned to the fuel tank 16 via a return line 18. In the illustrated system, an accelerator pedal is connected to a delivery control 22 on a fuel pump 24.

It is known to install in a system of the type shown by FIG. 1 a speed control device which simply comprises a bypass line 24, 24' extending from the fuel delivery line 10 back to the fuel tank 16, an off-on valve 26 in the bypass line 24, 24', and a control circuit for opening and closing the off-on valve 26 which includes a vehicle speed sensor 28. Let it be assumed that the vehicle speed has exceeded a predetermined maximum speed due to driver control at the accelerator pedal 20. In other words, the driver has pushed down on the accelerator pedal 20 for the purpose of increasing fuel to the engine 12 to in that manner increase engine output and vehicle speed. Under such conditions the vehicle speed sensor 28 senses the vehicle speed. In response to an increase of vehicle speed above a predetermined maximum the control circuit which includes the sensor 28 functions to open the valve 26. The opening of valve 26 decreases fuel flow to the engine 12 by diverting some of the fuel flow through the bypass line 24, 24' back to the fuel tank 16.

A prior art speed control unit 30 is shown by FIG. 2. It comprises the aforementioned off-on valve 26. The off-on valve 26 comprises an orifice which is either open or closed depending on the position of a closure member 32. Closure member 32 is moved between an open position and a closed position by an electrical solenoid 34. The solenoid 34 surrounds a central cavity in which the closure member 32 is situated. Valve 26 includes a coil spring 36 which acts on the closure member 32 so as to normally bias it into a closed position on the valve seat, thus closing the orifice 38. Solenoid 34, when energized, retracts the closure member 32, thus opening the orifice 38 so that the bypass line 24, 24' is an open passageway extending from the fuel delivery line 10 back to the fuel tank 16.

It is necessary to maintain a minimum delivery pressure to the engine 12 in an amount sufficient to assure the presence of an adequate amount of fuel at the engine 12 to sufficiently cool the fuel injectors 14. Under some conditions of operation, the vehicle speed may be relatively high while fuel delivery by operation of the accelerator pedal 20 is relatively low, such as when the vehicle is traveling downhill and the driver has eased up on the accelerator pedal 20. The vehicle speed sensor 28 signals an overspeed condition. If the off-on valve 26 is allowed to remain open in response to vehicle speed only, the flow of fuel through the bypass line 24, 24' can cause a decrease of fuel delivery to the fuel injectors 14 below what is needed to keep fuel injectors 14 adequately cool. To solve this problem, the prior art speed control unit 30 shown by FIG. 2 is equipped with a pressure switch 40 in the electrical circuit which provides electrical energy to the solenoid 34. The pressure switch 40 is connected to sense pressure in the bypass line 24 upstream of the off-on valve 26. This pressure is indicative of the delivery rate of fuel to the fuel injectors 14. Pressure switch 40 functions, in response to a drop in pressure in line 24, to de-energize the solenoid 34. This causes the spring 36 to immediately move the closure member 32 against the valve seat, thus closing the valve orifice 38. A problem with this type of system is that just as soon as the orifice 38 is closed, there is a quick increase of pressure in line 24. The increase in pressure is sensed by the pressure switch 40 and it functions to re-energize solenoid 34. Solenoid 34 then immediately retracts closure member 32 so as to again open orifice 38. In response, there is a quick reduction in pressure in line 24 causing pressure switch 40 to again de-energize the solenoid 34. As a result, the on-off valve 26 is repeatedly turned on and off until either the delivery fuel pressure in line 24 is up where pressure switch 40 does not function, or the vehicle speed has slowed to where a diversion of fuel through the bypass line 24 is not needed and the off-on valve 26 is turned off.

It is not desired that the valve 26 be oscillated on and off while it is in use for controlling flow through the bypass line 24, 24'. The frequent movement of the closure member 32 against the valve seat accelerates wear on the seal at the end of the closure member 32. The seal is made of an elastomeric material and as it wears it becomes deformed. The effect of this wear is to increase the stroke of the closure member 32. If the wear is sufficient, the stroke may be increased beyond the capacity of the solenoid 34, rendering the speed control unit 30 nonfunctional.

FIGS. 3–7 illustrate an embodiment of the speed control unit 42 of the present invention. As indicated in FIG. 1, speed control unit 42 can be substituted for the prior art speed control unit 30 without any other change to the system being necessary.

Referring now to FIGS. 3–7, the speed control unit 42 comprises a housing 44 which is a common housing for off-on valve 26 and a line pressure responsive flow control valve 46 which is in series with the off-on valve 26. The off-on valve 26 in speed control unit 42 is essentially identical to the off-on valve 40 in speed control unit 30. It comprises a solenoid 34 which surrounds a tubular space 48 in which the closure member 32 is received. Closure member 32 carries an elastomeric seal 50 at its inner end. Closure member 32 includes an annular flange 52 against which one end of spring 36 abuts. The opposite end of spring 36 abuts a shoulder 54 that is formed at the base of nipple 56. Nipple 56 has external threads 58 (FIG. 7) which mate with internal threads 60 which are formed in a cavity 62 which in turn is formed in a side portion of the housing 44. As will be apparent, the solenoid 34 is connected to the housing 44 by the threads 58, 60.

A chamber 64 is formed at the base of the cavity 62. This chamber 64 is outwardly closed by the housing for the solenoid. The seal 50 is positioned in this chamber 64. The wall at chamber 64 that is directly opposite the seal 50 includes a valve orifice 38. Valve orifice 38 is immediately surrounded by valve seat 59. An O-ring seal 60 is positioned between the nipple 56 and the base region of the threaded portion of recess 62. When the solenoid housing is installed the O-ring seal 60 is compressed and serves to seal against fluid leakage at the threads 58, 60.

The line pressure responsive flow control valve 46 comprises a closure member 66 in the form of a piston which is slidably received in a piston chamber 68. Piston 66 includes an end wall 70 that is directed towards a first end 72 of chamber 68. The opposite end of chamber 68 communicates with an opening 73 in an end portion of the housing 44. As clearly illustrated by FIGS. 3 and 4, the piston 66 may comprise a cylindrical sidewall 74 that is connected at one end to the end wall 70 and which extends from end wall 70 towards the opening 73. A coil spring 76 is received within the hollow interior of the piston 66. One end of spring 76 bears against the inner surface of piston end wall 70. The opposite end bears against an abutment 78 shown in the form of a disc having a diameter slightly smaller than the diameter of piston chamber 68. In preferred form, an annular groove 78 is formed in the inner wall of piston chamber 68, closely adjacent the opening 73. Groove 79 is provided to receive a retainer ring 80 which, when installed, holds the abutment 78 within the piston chamber 68. Piston 66 includes a peripheral groove adjacent end wall 70 in which an O-ring 84 is received. The O-ring 84 seals against fluid leakage between the piston 66 and the sidewall of the piston chamber 68. An opening 69 in abutment vents the interior of piston 66.

In preferred form, a nipple 86 is provided at the inner end of piston chamber 68, to extend from end wall 72 into the piston chamber 68. A valve seat 88 is formed at the end of nipple 86. Valve seat 88 surrounds a valve orifice 90. Spring 76 normally biases end wall 70 into contact with the valve seat 88. The nipple 86 spaces the seated piston end wall 70 away from the piston chamber end wall 72, so as to define a chamber space 92 endwise of the piston end wall 70, radially outwardly of the nipple 86 and the valve seat 88. In the illustrated embodiment the housing 44 is provided with an inlet port 94 and an outlet port 96. Ports 94, 96 are internally threaded for receiving connectors used to connect the unit 42 into the bypass line portions 24 and 24'. Inlet 94 is a part of an inlet passageway which connects the infeed portion 24 of bypass line 24, 24' with chamber space 92. Orifice 90 is at one end of a passageway 98 which serves as an outlet passageway for chamber space 92 and connects orifice 90 with chamber space 64 of off-on valve 26. A discharge passageway 100 connects valve orifice 38 with outlet 96.

Figure 4:
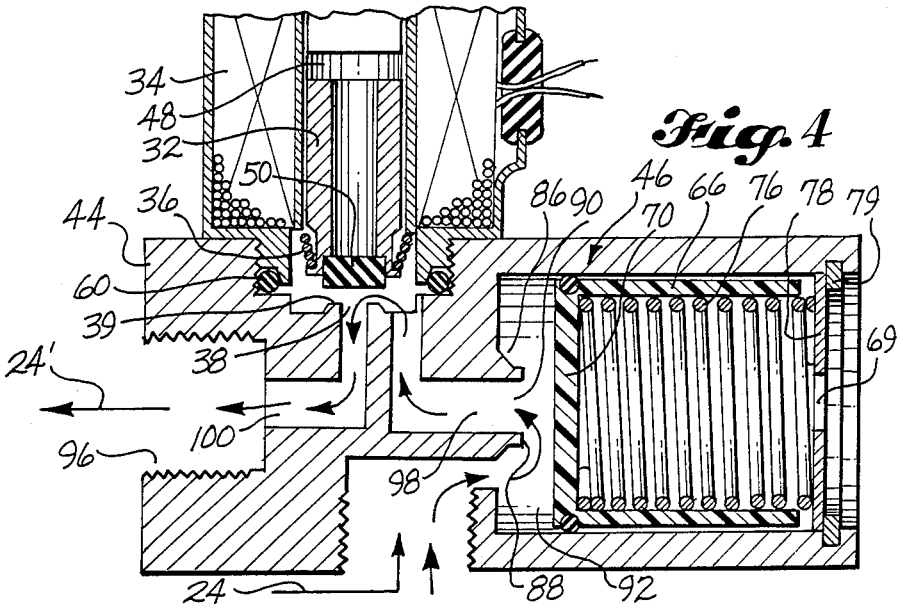
FIG. 4 is a view like FIG. 3, but on a slightly smaller scale, showing the line pressure responsive flow control valve open.

FIG. 3 shows off-on valve 26 and line pressure responsive flow control valve 46 in their closed positions. Spring 76 is compressed somewhat when in the position shown by FIG. 3. It possesses sufficient spring force to hold the piston 66 into a closed position against the valve seat 88 whenever the fuel pressure in chamber space 92 is below a predetermined pressure level. When fuel pressure in chamber space 92 exceeds the predetermined pressure the fuel exerts a force on piston end wall 70 that is greater than the force of spring 76, causing the piston 68 to move away from the valve seat 88. This condition is shown by FIG. 4. In some phases of operation, the fuel pressure in chamber space 92 is high enough to maintain the piston 66 spaced from valve seat 88 regardless of whether off-on valve 26 is open or closed.

In operation, the vehicle speed sensor 28 may detect an overspeed condition of the vehicle and in response to such condition function to energize solenoid 34, so as to open off-on valve 26. The fuel pressure in chamber space 92, acting on piston end wall 70, may be sufficiently large to hold the end wall 70 spaced from the valve seat 88, in which case there will be fuel flow from fuel delivery line 10, into bypass line portion 24, then through valve orifice 90, then through valve orifice 38, and then through bypass line portion 24', into the fuel tank 16.

Fluctuations in fuel pressure in lines 10 and 24 while the overspeed condition of the vehicle continues, may cause flow regulating movement of the piston 76, without the valve orifice 90 ever being closed. However, a decrease of fuel pressure in lines 10, 24 of sufficient magnitude to reduce the fuel pressure in chamber region 92 below what is necessary to overcome the force of spring 76, will allow spring 76 to function and move the piston end wall 70 into a position against valve seat 88, so as to block flow through valve orifice 90. In this manner fuel flow through the bypass line 24 is blocked. This happens even though the vehicle speed sensor 28 continues to sense an overspeed condition and continues to keep the off-on valve 26 in an open position.

The speed control unit of the present invention eliminates the use of a pressure switch control for the solenoid 34 and as a result changes the operation of the off-on valve 26 so that it is not rapidly turned on and off as a part of the delivery pressure control function of the speed control unit. In the speed control unit of the present invention the off-on valve 26 remains in an open position so long as the vehicle speed sensor detects a vehicle overspeed condition. The line pressure responsive flow control valve 46 functions to divide flow between the delivery line 10' leading to the engine 12 and the bypass line 24, 24'. Piston 64 may regulate flow by moving towards and away from the valve orifice 90, without coming to a seated position on the valve seat 88.

FIG. 8 shows a slightly modified form of the invention. In this embodiment the nozzle 86 is replaced by a well 87. The piston wall 70' carries a plug 71. Inlet port 94' in housing 44' intersects a portion of the well 87. The orifice 90' is at the base of the well 87 and is surrounded by the valve seat 88'. When the line pressure responsive valve is closed the plug 71 is within the orifice 90'.

It is to be understood that the above-described embodiments are merely two of many possible embodiments of the invention. The invention is not to be limited by the disclosed details but rather is to be defined by the appended claims, interpreted in accordance with the principles of patent claim interpretation, including use of the doctrine of equivalents.

What is claimed is:

1. A speed control system for a vehicle having an engine and a fuel tank, comprising:

a fuel delivery line for delivering fuel under pressure to the engine;

a bypass line connected to the fuel delivery line and extending to the fuel tank;

an off-on valve in said bypass line including a solenoid for opening and closing the off-on valve, said off-on valve being normally closed and when closed preventing fuel flow from the fuel delivery line through the bypass line to the fuel tank;

a speed sensor for sensing vehicle speed connected to the solenoid for the off-on valve and in response to the vehicle speed exceeding a predetermined speed controlling said solenoid to open the off-on valve;

a line pressure response flow control valve in said bypass line in series with and upstream of said off-on valve, said line pressure responsive flow control valve including a closure member presenting a pressure surface in the upstream direction, and a spring normally biasing the closure member into a closed position, wherein fuel in the bypass line upstream of the closure member will exert pressure on the pressure surface of the closure member and when said pressure exceeds a predetermined pressure, will move the closure member into a valve opening position, said line pressure responsive flow control valve functioning to control fuel flow through the bypass line when the off-on valve is open;

said line pressure responsive flow control valve comprising a housing defining a piston chamber having first and second ends and a sidewall, an outlet passageway including a valve orifice positioned at the first end of the piston chamber, a valve seat surrounding said orifice, said closure member comprising a piston within said piston chamber having a sidewall and a piston end wall directed towards said orifice and said valve seat, seal means between said piston sidewall and said piston chamber sidewall, sealing against pressure leakage between the two sidewalls during piston movement, said spring being positioned between the second end of the piston chamber and said piston end wall and functioning to normally bias the piston end wall into contact with the valve seat, said housing including a vent opening on the spring side of the piston, communicating the chamber behind the piston with atmospheric pressure, and an inlet passageway for delivering fuel from the bypass line to the piston end wall against the side thereof opposite the spring, said inlet passageway communicating with said valve orifice and said outlet passageway when the piston end wall is moved away from the valve seat by fuel pressure acting on the piston end wall in opposition to the spring force.

2. A system according to claim 1, wherein said off-on valve and said line pressure responsive flow control valve are in a common housing.

3. A system according to claim 1, wherein said first end of said piston chamber includes a reaction surface at the piston chamber and the outlet passageway includes a tubular portion which extends from the reaction surface towards the piston end wall and positions the orifice and the valve seat away from the reaction surface, so that a chamber space is defined axially between the reaction surface and the piston end wall when the piston end wall is against said valve seat, and said inlet passageway leading into said chamber space.

4. A system according to claim 3, wherein said piston comprises a cylindrical wall connected to said piston end wall and extending from said piston end wall towards the second end of the piston chamber, and wherein said spring is at least in part located within said cylindrical wall.

5. A system according to claim 4, wherein said housing includes an opening at the second end of said piston chamber sized to permit insertion of the piston into and removal of the piston out from said piston chamber via said opening, a spring abutment at the second end of the piston chamber, and said spring including an outer end which bears against said spring abutment.

6. A system according to claim 5, wherein said spring abutment comprises a plate within the piston chamber against the outer end of the spring and a removable retainer connected to the housing and positioned in the path of the plate and functioning to prevent the plate from being pushed by the spring out through said opening.

7. A system according to claim 1, further comprising a plug carried by the end wall directed towards said orifice, said spring functioning to normally bias said plug into the orifice and into contact with the valve seat, and said inlet passageway communicating with said valve orifice and said outlet passageway when the plug is moved away from the valve seat by fuel pressure acting on the piston end wall.

8. A system according to claim 7, wherein said first end of said piston chamber includes a well having a base and the orifice and the valve seat are at the base of the well, and said inlet passageway leads into said well.

9. In a speed control system for a vehicle comprising a fuel powered engine, a fuel delivery line for delivering fuel under pressure to the engine, a fuel tank, a bypass line extending from the fuel delivery line to the fuel tank, an off-on valve in the bypass line which is normally closed, and a speed sensor for sensing vehicle speed and functioning to open the off-on valve in response to the vehicle speed exceeding a predetermined speed, the improvement comprising:

a line pressure responsive flow control valve in said bypass line in series with said off-on valve, said line pressure flow responsive flow control valve including a closure member presenting a pressure surface in the upstream direction, and a spring normally biasing the closure member into a closed position, wherein fuel in the bypass line upstream of the closure member will exert pressure on the pressure surface of the closure member and when said pressure exceeds a predetermined level will move the closure member into a valve opening position, said line pressure flow control valve functioning to control fuel flow through the bypass line when the off-on valve is open;

wherein said off-on valve and said line pressure responsive flow control valve are in a common housing and said line pressure responsive flow control valve is upstream of the off-on valve, said housing defining a piston chamber having first and second ends, an outlet passageway including an orifice positioned at the first end of the piston chamber, a valve seat surrounding said orifice, said closure member comprising a piston within said piston chamber having a piston end wall directed toward said orifice in said valve seat, said spring being positioned between the second end of the piston chamber and said piston end wall and functioning to normally bias the piston end wall into contact with the valve seat, and an inlet passageway for delivering fuel from the bypass line to the piston end wall against the side thereof opposite the spring, said inlet passageway, communicating with said orifice and said outlet passageway when the piston end wall is moved away from the valve seat by fuel pressure acting on the piston end wall; and wherein said off-on valve comprises a second valve orifice surrounded by a second valve seat and a second valve piston having an end wall directed towards said second valve orifice and said second valve seat, and an operator means for moving the second valve piston towards and away from a second valve orifice closing position against the second valve seat, said housing including an inlet port connected to said inlet passageway, an outlet port, a discharge passageway extending from the second valve orifice to the outlet port, a fluid chamber immediately upstream of said second valve orifice and said second valve seat, and wherein said outlet passageway leads into said fluid chamber.

10. The improvement of claim 9, wherein said first end of said piston chamber includes a reaction surface at the piston chamber and the outlet passageway includes a tubular portion which extends from the reaction surface towards the piston end wall and positions the orifice and the valve seat away from the reaction surface, so that a chamber space is defined axially between the reaction surface and the piston end wall when the piston end wall is against said valve seat, and said inlet passageway leading into said chamber space.

11. The improvement of claim 10, wherein said piston comprises a cylindrical wall connected to said piston end wall and extending from said piston end wall towards the second end of the piston chamber, and wherein said spring is at least in part located within said cylindrical wall.

12. The improvement of claim 11, wherein said housing includes an opening at the second end of said piston chamber sized to permit insertion of the piston into and removal of the piston out from said piston chamber via said opening, a spring abutment at the second end of the piston chamber, and said spring including an outer end which bears against said spring abutment.

13. The improvement of claim 12, wherein said spring abutment comprises a plate within the piston chamber against the outer end of the spring and a retainer connected to the housing and positioned in the path of the plate and functioning to prevent the plate from being pushed by the spring out through said opening.

14. A system according to claim 9, further comprising a plug carried by the end wall directed towards said orifice, said spring functioning to normally bias said plug into the orifice and into contact with the valve seat, said inlet passageway communicating with said valve orifice and said outlet passageway when the plug is moved away from the valve seat by fuel pressure acting on the piston end wall.

15. A system according to claim 14, wherein said first end of said piston chamber includes a well having a base and the orifice and the valve seat are at the base of the well, and said inlet passageway leads into said well.

* * * * *